US006616307B2

(12) United States Patent
Haenen et al.

(10) Patent No.: US 6,616,307 B2
(45) Date of Patent: Sep. 9, 2003

(54) LUMINAIRE

(75) Inventors: Ludovicus Johannes Lambertus Haenen, Eindhoven (NL); Franciscus Guillaume Peter Sools, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/935,887

(22) Filed: Aug. 23, 2001

(65) Prior Publication Data

US 2002/0024815 A1 Feb. 28, 2002

(30) Foreign Application Priority Data

Aug. 24, 2000 (EP) ..... 00202975

(51) Int. Cl.[7] ..... F21V 7/00

(52) U.S. Cl. ..... 362/341; 362/260; 362/225; 362/217; 362/245; 362/246; 362/335; 362/351; 362/361

(58) Field of Search ..... 362/231, 260, 362/225, 223, 307, 310, 245, 246, 217, 311, 290, 291, 328, 335, 351, 354, 355, 361

(56) References Cited

U.S. PATENT DOCUMENTS 5,530,633 A * 6/1996 Yuen ..... 362/184
5,580,156 A * 12/1996 Suzuki et al. ..... 116/63 P
5,836,669 A * 11/1998 Hed ..... 362/92
5,908,234 A * 6/1999 Kreeft ..... 362/223

OTHER PUBLICATIONS

Patent Abstract of Japan: Publication No.: 08007611 A, Date of Publication: 0800761; Application No.: 06155458, Date of Filing: Jun. 15, 1994 Int'l Class F21P May 2000.

* cited by examiner

*Primary Examiner*—Sandra O'Shea
*Assistant Examiner*—Bertrand Zeade

(57) ABSTRACT

The luminaire has a lamp housing (1) in which lamps L1, L2 of different color aspect can be accommodated, surrounded by a reflector (11) and a non-transparent, light-transmitting window (10). The window (10) gives access to a reflector housing (3) which is provided with means (31, 32; 33) for screening and directing light. In the lamp housing, light of different color or color temperature is efficiently and effectively mixed. The luminaire may have a compact shape and is suitable for illuminating rooms efficiently with light of a chosen color aspect through dimming of the lamps in relation to one another.

9 Claims, 2 Drawing Sheets

LUMINAIRE

BACKGROUND OF THE INVENTION

The invention relates to a luminaire provided with a lamp housing and holders for accommodating several electric lamps of different color aspect next to one another in the lamp housing, said housing having a non-transparent, light-transmitting window for allowing light to issue to the exterior.

Such a luminaire is known from JP-A-0 800 7611. In the known luminaire, three fluorescent lamps are accommodated next to one another inside the lamp housing, each surrounded by a filter in the respective colors red, green, and blue. The luminous flux of each lamp can be independently controlled, so that the color of the emerging light can be adjusted. The window is arranged opposite the lamps and is of a "milky" consistency. Requirements are imposed on the minimum distance of the lamps to the window and on the width of the window in relation to its distance to the lamps for the purpose of mixing the light coming from the lamps before it issues through the window.

It is a disadvantage of the known luminaire that the lamp housing is comparatively voluminous for the purpose of mixing the generated light. Another disadvantage is that there is a risk of inhomogeneity of the color of the window, so that color differences are visible. A major disadvantage is also that the efficiency of the luminaire is comparatively low.

SUMMARY OF THE INVENTION

It is an object of the invention to provide a luminaire of the kind described in the opening paragraph which is suitable for illuminating spaces with light of a chosen color aspect, which is efficient, and which has a construction allowing a compact shape.

According to the invention, this object is achieved in that a reflector with a reflection coefficient of at least 0.85 is present in the lamp housing, which reflector is positioned so as to surround at least substantially lamps arranged in the holders and which leaves the window free, in that the window has a surface area accounting for 10 to 70% of the total surface area of the reflector and the window together, and in that the window affords access to a reflector housing which comprises means for shaping light issuing through the window into a beam.

The means for shaping the light issuing through the window into a beam prevent a radiation in all directions and ensure that the light will arrive mainly there where it is desired, for example on a workbench or on a wall. The means may also serve to avoid that the light arrives where it is not desired, for example on a picture screen where it would cause unpleasant reflections. The luminaire thus has a property which is required for its application in space illumination. The means contribute to the efficiency of the luminaire.

Reflection of light on the reflector causes the light of the lamps accommodated in the holders to be mixed, while loss of light is effectively counteracted thereby. It is important in this respect that the reflection coefficient is comparatively high and is at least 0.85. This also contributes to the efficiency of the luminaire. The relative surface area of the window is also important for a good mixing, because a comparatively large window, larger than 70%, will give an insufficient mixing through reflections and because a comparatively small window, smaller than 10%, will cause losses owing to absorption by the reflector which are generally comparatively great. The good mixing of the light of the lamps owing to the reflections in the lamp housing means that the lamp housing can be compact. The window is illuminated with an at least substantially homogeneous color and acts as a secondary light source whose light is concentrated into a beam in the reflector housing and is thus further mixed. The possibility of having a compact lamp housing renders possible a comparatively small window, and thus a compact reflector housing and a compact luminaire.

It is favorable for counteracting light losses if the reflector in the lamp housing has a reflection coefficient of at least 0.90. Furthermore, it is preferred that the window has a surface area amounting to 50 to 60% of the total surface area of the reflector and the window, because a very good mixing of light is obtained in that case, while light losses are minimized.

The luminaire may be used for lighting spaces, in which case the color aspect of the light can be adapted to the circumstances, for example to the incoming daylight, the personal taste of the user, or the nature of the work carried out in the spaces.

It is favorable when the holders of the luminaire are suitable for accommodating fluorescent lamps, in particular elongate tubular fluorescent lamps. Fluorescent lamps have a comparatively high luminous efficacy and may themselves have a chosen color aspect. The term "color aspect" here denotes both the "color" itself, such as a color of the rainbow such as a primary color red, green, or blue, as well as the "color temperature" such as, for example, 2700 K and 6500 K. The color temperature of a lamp here indicates the temperature of a black body whose radiation substantially corresponds to the—white—light of the lamp.

Fluorescent lamps radiate light having a color or a color temperature in that ultraviolet radiation generated in the electric discharge inside the lamps is directly converted into light by a fluorescent material or a mixture of fluorescent materials in the lamps. The lamps themselves have a high luminous efficacy, i.e. without the use of filters which absorb light which is accordingly lost, given the efficient fluorescent substances usual nowadays.

Tubular fluorescent lamps have one or two contact pins at both ends of their tubes, by means of which they can be accommodated in suitable holders arranged for contacting of a pin, for holding them mechanically, and for supplying them electrically. The holders for these lamps cooperate in pairs for holding a lamp. Tubular fluorescent lamps having two substantially parallel tube portions in series have their contact pins next to one another at free ends of the tube portions. These lamps have the advantage that they are supplied electrically at one end. The latest generation of tubular fluorescent lamps in general has a tube diameter of approximately 16 mm or less, so that two or more lamps placed next to one another transversely to the tube length together occupy only little space. The holders for accommodating tubular fluorescent lamps are accordingly designed for contacting pin-shaped lamp contacts.

In a favorable embodiment of the luminaire according to the invention, in which the holders are suitable for accommodating tubular fluorescent lamps, the holders are present outside the reflector of the lamp housing. The holders do not emit light, neither do the portions of the tubular lamps adjoining thereto. If the holders and, preferably, also the dark bands of the tubular fluorescent lamps adjoining the holders on account of the positions of the holders are outside the reflector, said holders, and preferably said dark bands of the lamps, cannot absorb any light. This benefits the efficiency of the luminaire. It is favorable also for the heat balance, and thus for the luminous efficacy of the lamps, when end portions of the lamps lie outside the reflector owing to the fact that the holders are outside the reflector.

The lamp housing of the luminaire, and thus also the luminaire itself, is particularly compact if the surface area of the window accounts for 50 to 100% of the total surface area of the lamps to be accommodated in the holders enclosed by the reflector and the window. The luminaire then also has a good efficiency and a good light homogeneity.

The luminaire according to the invention is capable of generating white light with two lamps of different color temperature, which light may have all color temperatures lying between the color temperatures of said lamps in that one lamp is dimmed. Light can be generated with two lamps of different colors, which light has all mixed colors of said two colors, while it is possible to obtain all colors as well as white light having all color temperatures by means of three lamps having the primary colors red, green, and blue, respectively. A comparatively high light level can be obtained when the lamps are not or substantially not dimmed.

The lamp housing may have a variety of shapes. It may have, for example, a rectangular, for example square shape in cross-section, or alternatively round or oval. The lamps may be accommodated therein alongside the window, for example substantially parallel thereto. The lamps may then lie in a first plane, perpendicular to the window, or in a plane perpendicular to the first plane. Alternatively, the lamps may be placed on the edges of a virtual prism.

The reflector of the lamp housing may be diffusely or specularly reflecting. The reflector may consist of one or several separate bodies, or alternatively walls of the lamp a housing themselves may be the reflector. The reflector may be made of a painted material, for example metal, or of a synthetic resin, or alternatively it may have a metal reflecting surface, for example of aluminum, or a stack of layers of alternating refractive indices on a carrier, for example made of synthetic resin, thus forming a dichroic reflector. The reflection coefficient of aluminum used in luminaires generally lies between approximately 0.85 and 0.95. Dichroic reflectors in general have a reflection coefficient of approximately 0.93 to 0.995. If the window accounts for a comparatively small portion of the total surface area of the reflector and the window together, it is favorable to use a reflector having a comparatively high reflection coefficient.

It is possible that the reflector, for example a dichroic reflector, has at least a region which transmits a portion of the light which is not reflected. If the luminaire is mounted against or to a carrier, for example a ceiling, this embodiment of the luminaire may be useful for weakly illuminating the ceiling in the immediate surroundings of the luminaire.

The window may be white and light-scattering, for example have a light-scattering coating or may be made of a light-scattering material, for example polymethylmethacrylate (PMMA) with a coating thereon or a dispersion therein of, for example, a white fluorescent powder. Such powders have a low light absorption. It is advantageous if the window has approximately 50% transmission and approximately 50% reflection. Alternatively, the window may be made of transparent material and have a prismatic profile on its surface facing away from the lamps, so that it is light-transmitting and yet non-transparent. Such a window allows the generated light to pass in a narrower beam than does a light-scattering window.

The window may be regarded as a secondary light source. The emerging light may be directed and formed into a beam as though the window were a lamp. The means of the reflector housing may comprise reflectors laterally on either side of the window, concentrating the radiated light into a beam and at the same time screening off spatial angles laterally of the luminaire. It is achieved by means of this screening that, when the luminaire is fastened, for example against or in a ceiling, no light is radiated in lateral directions within the cut-off angle against the ceiling. The reflectors of the reflector housing may be accommodated in the reflector housing or may themselves form part of the housing. The reflectors may be made of usual materials such as, for example, synthetic resin, painted metal such as steel, aluminum, or of frosted, semi-bright, or mirroring metal.

The reflector housing may furthermore comprise means for concentrating light in directions transverse to the reflectors into a beam and cutting it off in those directions. These means may comprise, for example, lamellae which extend transversely between the reflectors opposite the window. The lamellae may be flat plates, or alternatively three-dimensional bodies, for example parabolically curved bodies.

The luminaire may be of multiple construction, for example with several windows in the same number of lamp housings together, for example, forming one constructional whole, and with several reflector housings. It is also possible for one lamp housing to have several windows. It then holds for the windows that their joint surface area lies between 10 and 70%, in particular between 50 and 60% of the total surface area of the windows and the reflector. A second window may then be arranged opposite a first window so that the luminaire is capable of giving light in two directions, for example direct and indirect lighting simultaneously.

Dimmers for controlling the power consumption of each of the lamps may be present in the luminaire or outside the luminaire, for example in a false ceiling.

BRIEF DESCRIPTION OF THE DRAWINGS

Embodiments of the luminaire according to the invention are shown in the drawing, in which.

DETAILED DESCRIPTION OF THE PREFERRED EMBODIMENTS

Figure 1:
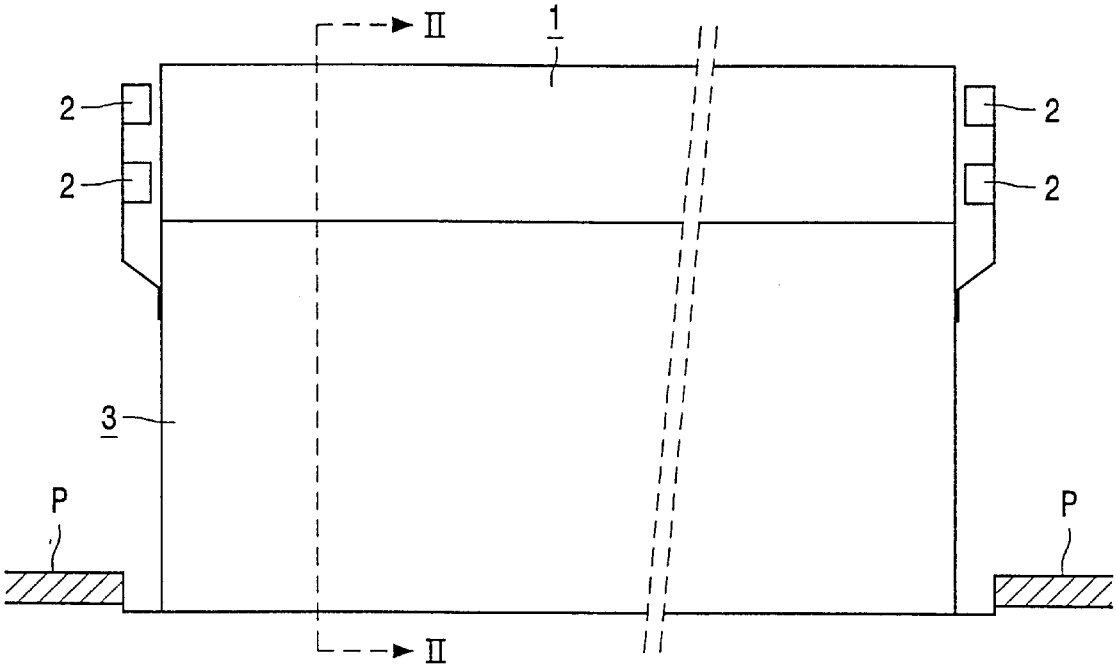
FIG. 1 shows an embodiment of the luminaire in side elevation.
Figure 2:
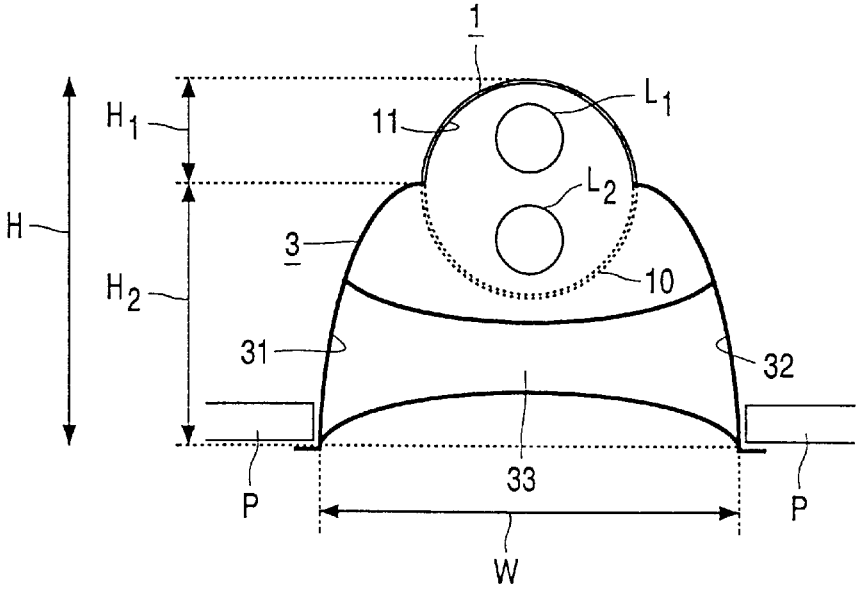
FIG. 2 is a cross-section taken on the line II—II in FIG. 1.

The luminaire of FIGS. 1 and 2 is provided with a lamp housing 1 and holders 2 for accommodating several electric lamps of different color aspect next to one another in the lamp housing 1. The housing 1 has a non-transparent, light-transmitting window 10 for allowing light to issue to the exterior.

A reflector 11 with a reflection coefficient of at least 0.85 is present in the lamp housing 1 and positioned so as to surround lamps placed in the holders 2 at least substantially. The reflector 11 leaves the window 10 free. The window 10 has a surface area of 10 to 70% of the total of the surface areas of the reflector 11 and the window 10. The window 10 affords access to a reflector housing 3, which has means for shaping light issuing through the window 10 into a beam. The lamp housing 1 has the shape of a circular-cylindrical tube in FIGS. 1 and 2.

The reflector housing 3 shown has as its means for concentrating light issuing through the window 10 into a beam reflectors 31 and 32 which extend on either side of the window 10 and which concentrate light issuing through the window 10 into a beam in the plane of drawing and in planes enclosing acute angles therewith, while hampering radiation of light at small angles to a ceiling P against or in which the luminaire can be mounted in the position drawn.

The means in the embodiment shown comprise also a plurality of mutually substantially parallel lamellae 33, one of which is visible. The lamellae concentrate the light into a beam perpendicular to the plane of drawing, and in planes enclosing an acute angle therewith, while hampering radiation of light at small angles, for example 0° to 30°, to the ceiling P in said plane. The reflectors 31, 32 and the lamellae 33 are made of aluminum with a reflection coefficient of approximately 0.85 in the embodiment shown.

A reflector 11 with a reflection coefficient of at least 0.97 is present in the embodiment of the lamp housing 1 depicted in FIGS. 1 and 2. The reflector 11 is a dichroic reflector of synthetic resin with a stack of layers of alternating refractive index thereon, having a reflection coefficient of 0.97.

The window 10 in the embodiment shown has a surface area of 50 to 60% of the total surface area of the reflector 11 and the window 10, i.e. 52%. The window 10 in the embodiment shown is a PMMA foil with prismatic ridges in the longitudinal direction of the lamps L1 and L2.

The holders 2 are designed for accommodating a first and a second tubular fluorescent lamp, for example a first and a second tubular fluorescent lamp of different color temperatures: a linear tubular lamp L1 in the Figures which radiates white light with a color temperature of 6500 K during operation, and adjacent thereto a linear tubular lamp L2 which radiates white light with a color temperature of 2700 K during operation. The holders are positioned so as to accommodate the lamps in a plane perpendicular to the window.

The holders 2 are placed outside the reflector 11 of the lamp housing 1, see FIG. 1.

The window 10 shown has a surface area of 65% of the surface areas of the lamps L1 and L2 together situated within the reflector 11 and the window 10. The lamps shown have a diameter of 16 mm.

Illumination with light of 2700 K is obtained in that the lamp L1 is extinguished, which is pleasant, for example, at night or at a low ambient temperature; illumination with light of 6500 K is obtained in that the lamp L2 is extinguished, which is suitable, for example, at high ambient temperatures and in combination with incident daylight. Homogeneous light of an intermediate color temperature is obtained in that both lamps are made to burn, which color temperature may have any value between 2700 and 6500 K in dependence on the relative light output during dimming.

The luminaire shown has a total height H of 6.9 cm, of which the reflector 11 has a height H1 of 1.9 cm and the reflector housing 3 a height H2 of 5 cm. The luminaire shown has a width W, i.e. the greatest distance between the reflectors 31 and 32, of 8 cm, which corresponds to the width of commercial luminaires for one fluorescent lamp, which have a total height of 5.2 cm.

The efficiency of the luminaire shown, i.e. the ratio of the quantity of light radiated by the luminaire to the quantity of light generated by the lamps, is 66%. An optimized commercial luminaire with the same reflector housing and also a reflector above the accommodated lamp, opposite the lamellae, has an efficiency of 73%. The luminaire is compact, effective, and efficient in mixing of light and also in beam-shaping of light, because it has an efficiency which is only slightly slower than that of the commercial reference luminaire of good quality.

A modification of the luminaire of FIGS. 1 and 2 differs therefrom in that the dichroic reflector has a reflection coefficient of 0.99, and in that the window has a surface area of 59% of the total surface area of the window and the reflector of the lamp housing. The luminaire efficiency is 71%.

Figure 3:
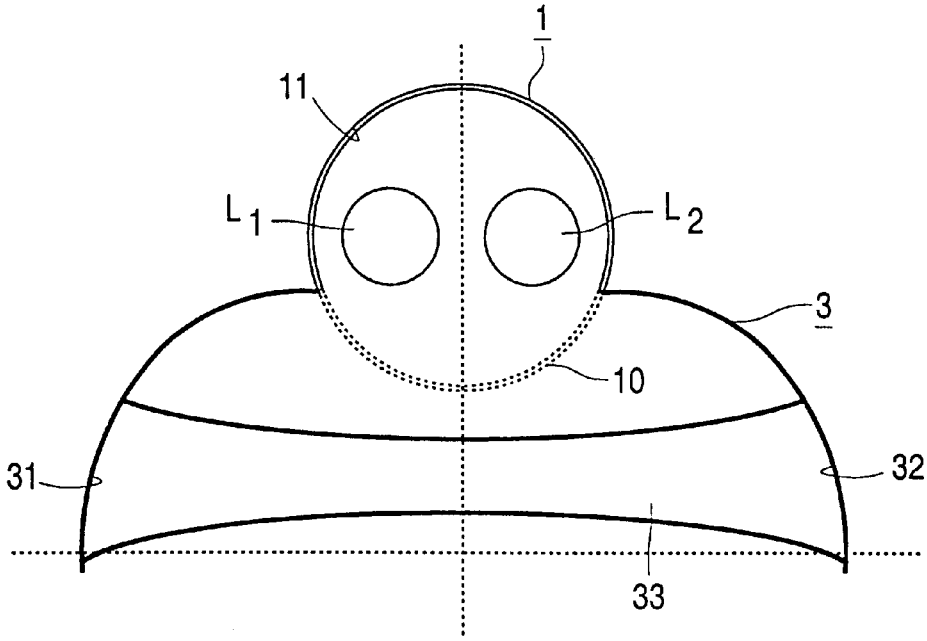
FIG. 3 is a similar cross-section of a second embodiment.
Figure 4:
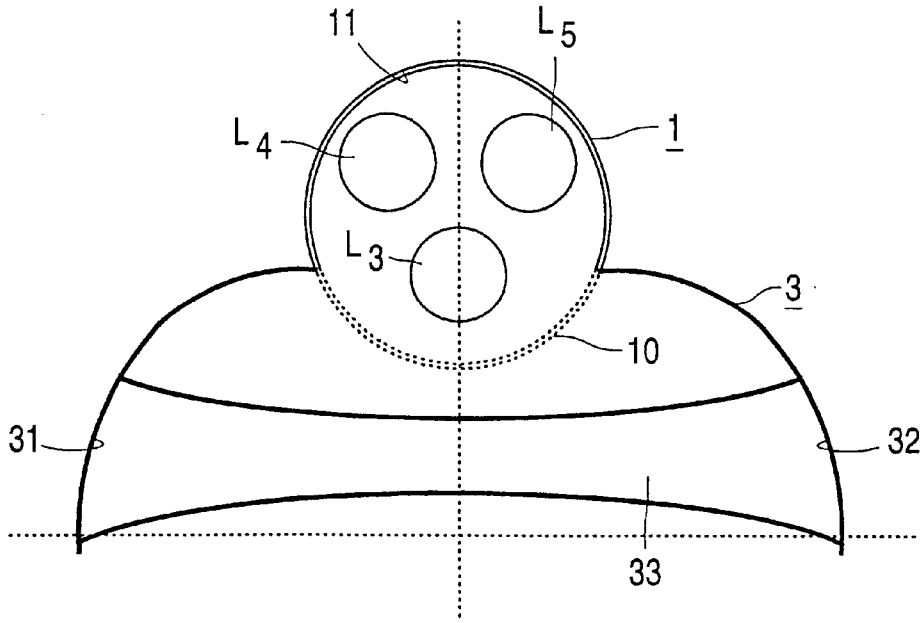
FIG. 4 is a similar cross-section of a third embodiment.

In FIGS. 3 and 4, components corresponding to components in FIGS. 1 and 2 have been given the same reference numerals.

In FIG. 3, the lamps L1 and L2 are placed in a plane perpendicular to a plane perpendicular to the window 10. Accordingly, they have substantially equal distances to the window 10. The reflector 11 of the lamp housing 1 in this Figure is provided with white paint.

In FIG. 4, a green lamp L3, a red lamp L4, and a blue lamp L5 are accommodated next to one another on the edges of a virtual prism whose base is directed away from the window 10. Any color of the rainbow can be realized with this luminaire through variation of the relative dimming levels of the lamps, as well as white light of any color temperature.

What is claimed is:

1. A luminaire provided with a lamp housing (1) and holders (2) for accommodating several elongate tubular fluorescent lamps of different color aspect next to one another in the lamp housing (1), said housing (1) having a non-transparent, light-transmitting window (10) for allowing light to issue to the exterior, the window (10) is a PMMA foil with prismatic ridges in the longitudinal direction of the lamps, the luminaire characterized in that a reflector (11) with a reflection coefficient of at least 0.85 is present in the lamp housing (1), which reflector (11) is positioned so as to surround at least substanially lamps arranged in the holders (2) and which leaves the window (10) free, in that the window (10) has a surface area accounting for 10 to 70% of the total surface area of the reflector (11) and the window (10) together, and in that the window (10) affords access to a reflector housing (3) which comprises means for shaping light issuing through the window (10) into a beam, the means for shaping light comprising a plurality of lamellae (33) housed within a reflector housing (3) having an opening for receiving at least a portion of said housing (1).

2. A luminaire as claimed in claim 1, characterized in that a reflector (11) with a reflection coefficient of at least 0.97 is present in the lamp housing (1).

3. A luminaire as claimed in claim 1, characterized in that the window (10) has a surface are of 50 to 60% of the total surface area of the reflector (11) and the window (10) together.

4. A luminaire as claimed in claim 1, characterized in that the holders (2) are designed for accommodating a first and a second tubular fluorescent lamp.

5. A luminaire as claimed in claim 4, characterized in that the holders are designed for accommodating a first and a second tubular fluorescent lamp of different color temperatures.

6. A luminaire as claimed in claim 4, characterized in that the holders (2) are positioned outside the reflector (11) of the lamp housing (1).

7. A luminaire as claimed in claim 1, wherein the window (10) is a PMMA foil with prismatic ridges in the longitudinal direction of the lamps.

8. A luminaire as claimed in claim 1, wherein the plurality of lamellae (33) are made of aluminum and are substanially parallel with respect to each other.

9. A luminaire as claimed in claim 1, wherein the reflector (11) is a dichroic reflector of synthetic resin with a stack of layers of alternating refractive index.

* * * * *